US005107187A

United States Patent [19]

Miscikowski

[11] Patent Number: 5,107,187

[45] Date of Patent: Apr. 21, 1992

[54] HIGH VOLTAGE PROTECTION RESISTOR

[75] Inventor: Gary R. Miscikowski, San Diego, Calif.

[73] Assignee: Maxwell Laboratories, Inc., San Diego, Calif.

[21] Appl. No.: 622,921

[22] Filed: Dec. 6, 1990

[51] Int. Cl.[5] ..... H01F 17/36; H05G 1/32

[52] U.S. Cl. ..... 315/326; 315/349; 378/121; 378/110; 378/112

[58] Field of Search ..... 315/326, 349, 307, 334; 378/121, 134, 91, 109, 110, 111, 112, 106

[56] References Cited

U.S. PATENT DOCUMENTS

| | | | |
|---|---|---|---|
| 1,959,285 | 5/1934 | Fryling | 201/75 |
| 3,560,905 | 2/1971 | Rietz et al. | 338/62 |
| 4,319,216 | 3/1982 | Ikeda et al. | 338/61 |
| 4,361,901 | 11/1982 | Daniels et al. | 378/106 |
| 4,489,230 | 12/1984 | Yamamoto | 219/121 LM |
| 4,544,829 | 10/1985 | Adachi et al. | 219/237 |
| 4,916,428 | 4/1990 | Burke | 338/62 |

OTHER PUBLICATIONS

An article taken from the 6th Edition of McGraw-Hill Encyclopedia of Science & Technology entitled, "X-Ray Tube", pp. 577-580 (19 ULC-ZYT).

*Primary Examiner*—Eugene R. LaRoche
*Assistant Examiner*—Ali Neyzari
*Attorney, Agent, or Firm*—Fitch, Even, Tabin & Flannery

[57] ABSTRACT

A protection arrangement for a high voltage tube includes a low inductance disk resistor connected in series with the anode of the tube. When an electrical discharge occurs within the tube, the increased anode current flows through the resistor which absorbs much of the potentially harmful energy surge. The resistor is a disk resistor comprising two counter-wound planar spirals of resistance wire electrically connected in parallel and counter-wound with respect to one another. Connection arrangements are provided to both electrically and mechanically connect the resistor to the high voltage tube.

10 Claims, 3 Drawing Sheets

HIGH VOLTAGE PROTECTION RESISTOR

BACKGROUND OF THE INVENTION

The present invention relates to electrical protection apparatus and, particularly, to resistors for protecting high voltage electronic equipment from the harmful effects of electrical discharge within such equipment.

Modern x-ray equipment includes an x-ray tube which is energized by voltage of 50–100 thousand volts or more to create desired x-rays. The x-ray tube normally presents a high impedance of several hundred thousand ohms to the applied voltage, resulting in a relatively small current flow. Occasionally an electrical discharge occurs within the tube, drastically reducing its impedance, thereby increasing the current which flows through the tube. The large current occasioned by such a discharge can damage or shorten the life of the x-ray tube. This is a particularly serious problem since x-ray tubes may cost in excess of $30,000, and replacing them can result in large repair charges. Given the expenses involved, it is desirable to protect high voltage tubes such as x-ray tubes from damage caused by internal discharges.

It has been found that a low inductance resistor can be placed in series with the high voltage input to protect a high voltage tube from discharges. The resistor value is chosen to be relatively low with respect to the normal tube impedance, and to be substantially equal to the resistance of the high voltage source and its attaching conductors. When a tube including the protection resistor discharges, a substantial part of the applied voltage is dropped across the protection resistor, quenching the discharge and protecting the x-ray tube from damage.

The protection resistor should exhibit low inductance, have sufficient power handling capability to quench the discharge without damage to itself, and be of a relatively small size to permit connection of the resistor at a point as near to the high voltage tube input as possible.

Low inductance high power resistances are known in the art and as described, for example, in U.S. Pat. No. 3,360,905 to Rietz, et al. The Rietz, et al. patent discloses an arrangement in which a plurality of individual resistors are spirally wound, physically placed on top of one another, and serially connected to provide the needed resistance. The resistances are wound so that each layer spirals in a different direction than the layer or layers it is next to. Such winding and physical placement substantially reduces the inductance of the overall assembly. The resulting resistor is, however, large and not suitable for connection in existing x-ray equipment.

A need exists for a low inductance protection resistor which is of small size and capable of direct connection to existing high voltage tubes.

SUMMARY OF THE INVENTION

A high voltage power supplying assembly in accordance with the invention comprises a source of high voltage between a return conductor connected to a cathode of a high voltage tube and a high voltage conductor connected to an anode of the high voltage tube, via a low inductance protection resistor. The resistor is mechanically attached to the high voltage tube socket an is electrically connected in series with the high voltage conductor immediately prior to the connection to the anode. Attachment of the resistor at the tube socket places the resistor electrically close to the anode of the high voltage tube to be protected and simplifies the attachment and maintenance of the protection resistor. The nearness of the resistor to the high voltage tube maximizes the protection provided by the resistor.

In a preferred embodiment, the protection resistor comprises a plurality of planar spirals of resistance wire placed adjacent to and in parallel planes with one another. The resistances of the spirals are connected in electrical parallel and the inductance of the assembly is minimized by counter-winding adjacent ones of the spirals. That is, the spirals are "stacked" like plates, with the first wound clockwise, the second counterclockwise, the third (if present) wound clockwise, etc. After encapsulation, the resistor has a disk-shape with a conductive central hub first terminal and a conductive second terminal. The resistance is provided between the first and second terminals.

The planar spiral resistance elements are laid out around central hub and are connected to the central hub near the center of the spirals and to a common point which is connected to the second terminal at the perimeter of the spirals. A conductive corona ring which is electrically connected to the second terminal and to the common point at the perimeter of the resistive elements, surrounds the resistive elements. The conductive ring is coplanar with the resistive elements and provides electrical connection for the resistors as well as protection of the resistor from corona discharge.

The conductive central hub has an aperture therethrough. A threaded bolt passes through the hub aperture and an aperture in the high voltage tube socket to engage a threaded aperture in the anode circuit of the high voltage tube. The bolt thus mechanically secures the tube in the socket and electrically connects the resistor to the tube anode. The high voltage conductor from the power supply is connected to the second terminal of the resistor.

In one embodiment, the second resistor terminal comprises a conductive member connected to the corona ring and having a threaded aperture for connection to the high voltage conductor. In an alternative embodiment, a portion of the corona ring is exposed for slidable connection with a female banana-type connector on the high voltage connector.

DESCRIPTION OF THE PREFERRED EMBODIMENT

Figure 1:
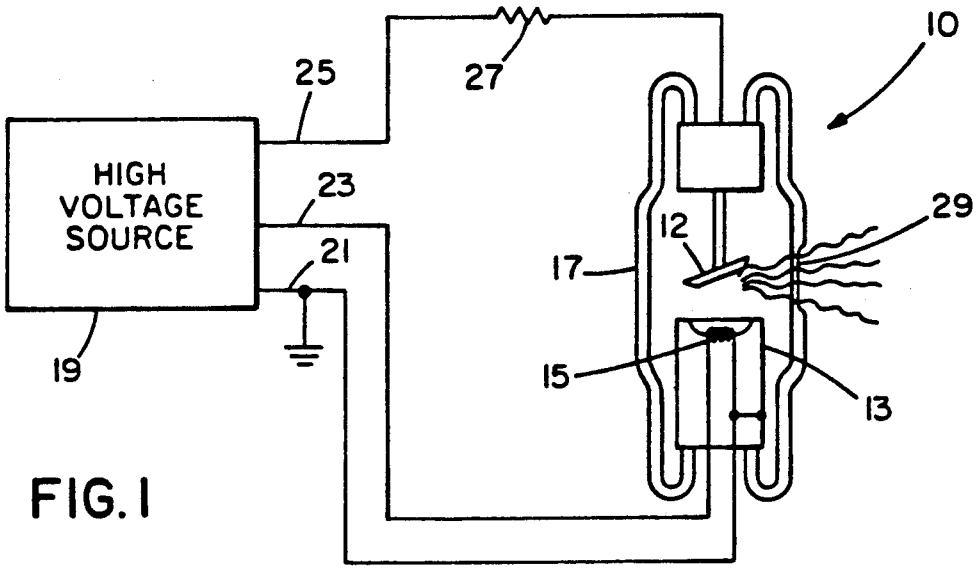
FIG 1 is a circuit diagram of an embodiment of the invention.

FIG. 1 is a circuit diagram of an embodiment of the present invention intended to illustrate use of the invention in conjunction with an x-ray generation tube shown at 10. The x-ray generation tube 10 includes an anode 12 and a cathode 13 which is heated by a filament 15. An envelope 17 encloses the anode, cathode and heater and maintains a substantial vacuum within its volume. FIG. 1 also includes a high voltage source 19 which provides the necessary power to energize the x-ray generating tube 10. The return conductor from high voltage source 19 is connected to the cathode 13 and to one terminal of heater 15. A low voltage heater current source conductor 23 is connected to the other terminal of heater 15. A high voltage on the order of 70 to 100,000 volts is applied to the anode 12 via a conductor 25 and a resistor 27. In prior arrangements, the resistor 27 was not present and conductor 25 connected directly to anode 12.

In operation current applied to heater 15, heats cathode 13 so that electrons are emitted thereby. The high voltage applied between anode 12 and cathode 13 accelerates the electrons toward the anode which is made from a high atomic number material such as tungsten. The anode 12 emits x-rays upon being struck by high energy electrons. The x-rays produced at anode 12 travel substantially to the right in FIG. 1 and exit the x-ray tube envelope via an x-ray transparent window 29.

During normal operation, the x-ray tube 10 presents a very high impedance on the order of several hundred thousand ohms between anode 12 and cathode 13. Occasionally, during operation a breakdown occurs within the x-ray generation tube reducing the impedance provided to a very low amount which allows the energy of the power supply and stored in the conductors 21 and 25 to pulse through the internal elements of the tube. This high energy discharge causes damage to internal tube components and either immediately burns out the tube or causes a significantly shorter tube life. Since x-ray generation tubes can cost upwards of $30,000 burnout or a significantly shortened lifetime represents a significant cost.

It has been determined that the harmful effects of x-ray generator tube breakdown can be substantially lessened by providing resistor 27 in series with the high voltage connection to the anode 12 of the x-ray generation tube 10. Preferably, the resistance value of resistor 27 is substantially equal to the combined resistance of the high voltage source 19 and conducting cables 21 and 25. In the present embodiment, resistor 27 has a resistance value of approximately 84 ohms. During normal operation resistor 27 has substantially no effect on the operation of the tube and the power dissipated by resistor 27 is low, since little current is drawn by x-ray generation tube 10. For example, if x-ray generation tube 10 draws one-fourth amp of current, resistor 27 reduces the applied voltage to the anode by only 21 volts and dissipates only approximately 5.25 watts. During breakdown of the x-ray generation tube 10, the resistance value of resistor 27 substantially reduces discharge currents and absorbs and dissipates most of the otherwise tube damaging high energy discharge.

The discharge energy at the x-ray generation tube 10 is caused by energy from high voltage source 19, as well as energy which is inductively stored within the high voltage conductors 21 and 25. For this reason, it is desirable that resistor 27 exhibit a low inductance and that resistor 27 be physically located as close to anode 12 as is possible. A low inductance resistor presents an impedance which is substantially all resistive when a tube discharge occurs. When the resistance of the resistor is approximately 84 ohms, an inductance of 5-10 micro henrys is considered to be a low inductance.

Figure 2:
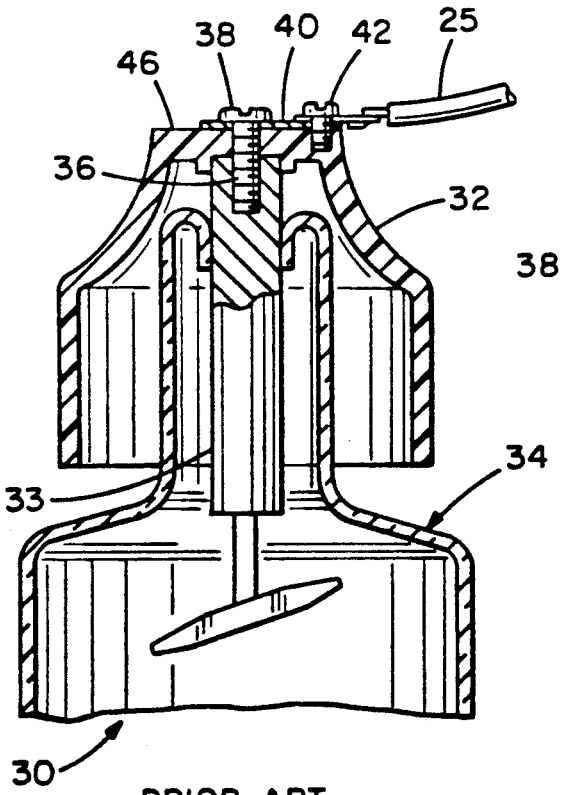
PRIOR ART FIG. 2
FIG. 2 is a sectional side view of an x-ray tube connected to a socket.

FIG. 2 is a sectional view of the anode portion of an x-ray generating tube 30, the socket 32 for receiving the x-ray generation tube and its connection to that socket. X-ray generation tube 30 as shown in FIG. 2 comprises an anode 33 and a vacuum envelope 34 which is sealed around anode 33 leaving a portion of anode 33 outside of envelope 34. The portion of anode 33 which is exterior to vacuum envelope 34 includes a threaded hole 36 which is engaged by an attaching bolt 38. Tightening bolt 38 secures tube 30 within socket 32. Socket 32 includes a flat conductive member 40, through which connecting bolt 38 is inserted before it is tightened into anode 33. Conductive member 40 is connected to high voltage input conductor 25 via a bolt 42, extending through conductive member 40 into a threaded hole in socket 32. The mechanical connection of bolt 38 holds x-ray generation tube 30 in socket 32 and completes an electrical circuit from high voltage conductor 25 through conducting member 40 and bolt 38 to the anode 33.

Figure 3:
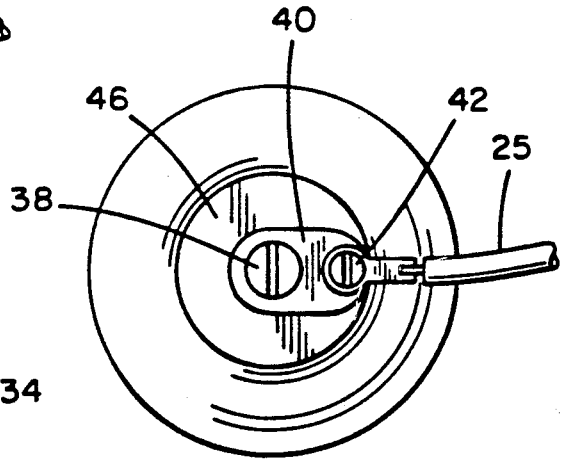
PRIOR ART FIG. 3
FIG. 3 is a top plan view of the socket of FIG. 2.

FIG. 3 is a top plan view of the socket of FIG. 2 showing high voltage conductor 25, the conductive member 40, the attachment bolts 42 and 38 and the substantially circular, flat upper surface 46.

Figure 4:
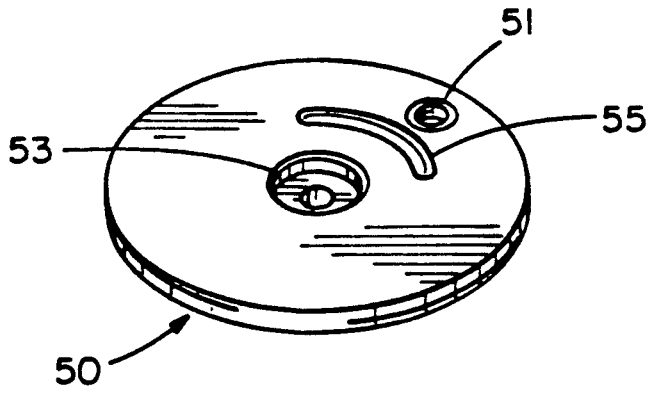
FIG. 4 is a perspective view of a disk-type protection resistor.

FIG. 4 is a perspective view of a resistor embodying the present invention for use in x-ray generation tube protection. Resistor 50 is substantially coin-shaped having a diameter slightly more than the diameter of the circular top 46 of tube socket 32. The resistor 50 includes a high voltage input terminal 51 which comprises a conducting member having an internal screw thread to receive bolt 42. A central hub 53 of conducting material is also provided. Central hub 53 includes a hole therethrough sufficiently large to pass connection bolt 38 so that bolt 38 can be placed through the hub 53 and secured to the x-ray generation tube anode 33 in the manner previously discussed. The resistance 27 is encapsulated within the non-conductive body of resistor 50 and provides its resistance between terminal 51 and hub 53. In the present embodiment, the body of resistor 50 is formed from a mixture of EPON 828 resin and EPON 871 hardened with AMICURE 101 hardener and vacuum molded into the configuration shown. Resistor 50 also includes a barrier 55 of non-conductive material between terminal 51 and hub 53.

Figure 5:
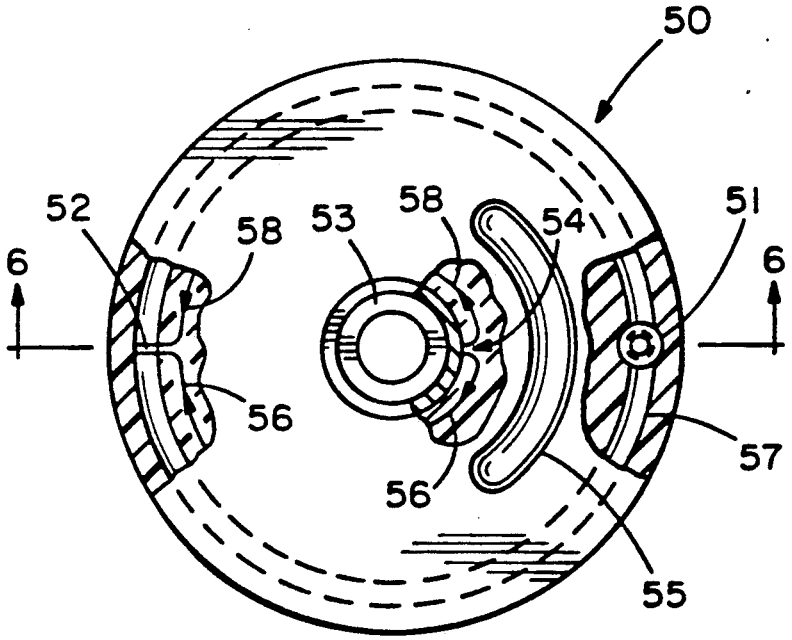
FIG. 5 is a top plan view of the resistor of FIG. 4 having cut-out sections showing its internal detail.
Figure 6:
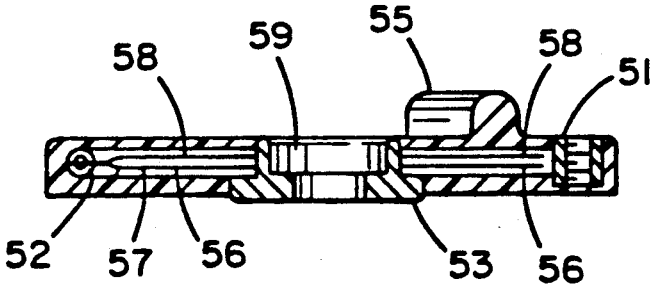
FIG. 6 is a side section view of the resistor of FIG. 5.

FIG. 5 is a top plan view of resistor 50 having cutouts showing detail of the internal structure. FIG. 6 is a side plan view of resistor 50 sectioned along line 6—6 of FIG. 5. Terminal 51 is electrically connected to a ring of conductive material 57 having a major diameter slightly less than the overall diameter of resistor 50 and having its major axis aligned substantially with the major axis of resistor 50. Conductive ring 57 is a split ring of solid copper rod. The sides of the split in ring 57 are silver-brazed to conductive terminal 51. The resistance of resistor 50 is provided by two spirally wound coils of resistance wire 56 and 58 which are electrically connected at one end to central hub 53 at a point 54 and at the other end to conductive ring 57 at a point 52. The two spirals of resistance wire 56 and 58 are counterwound and laid out in parallel planes within resistor 50. Each spiral consists of approximately 60 turns of WIREX Co. W-10-QML wire or its equivalent, making each resistance element 56 and 58 have a resistance of approximately 168 ohms. Since the resistive elements 56 and 58 are connected in electrical parallel a resistance of approximately 84 ohms is presented between central hub 53 and terminal 51. Conductive ring 57 performs two functions in the resistor assembly. The first function is the electrical connection of input terminal 51 to resistance elements 56 and 58. Secondly, ring 57 functions as a corona ring to protect resistor 50 and adjacent equipment from harmful effects of corona discharge.

As shown in FIG. 6, hub 53 extends from the top to the bottom of coin-shaped resistor 50 and comprises a solid conductive member. A recess 59 is machined or otherwise formed in hub 53 to receive the head of connection bolt 38 so that upon tightening, stresses are applied only to the washer shaped bottom (FIG. 6) of hub 53. Terminal 51 comprises a cylindrical brass member into which suitable connection threads have been tapped. The top of terminal 51 is substantially level with the encapsulation material at the top of resistor 50, however, insulating encapsulation material covers all other sides of terminal 51.

Figure 7:
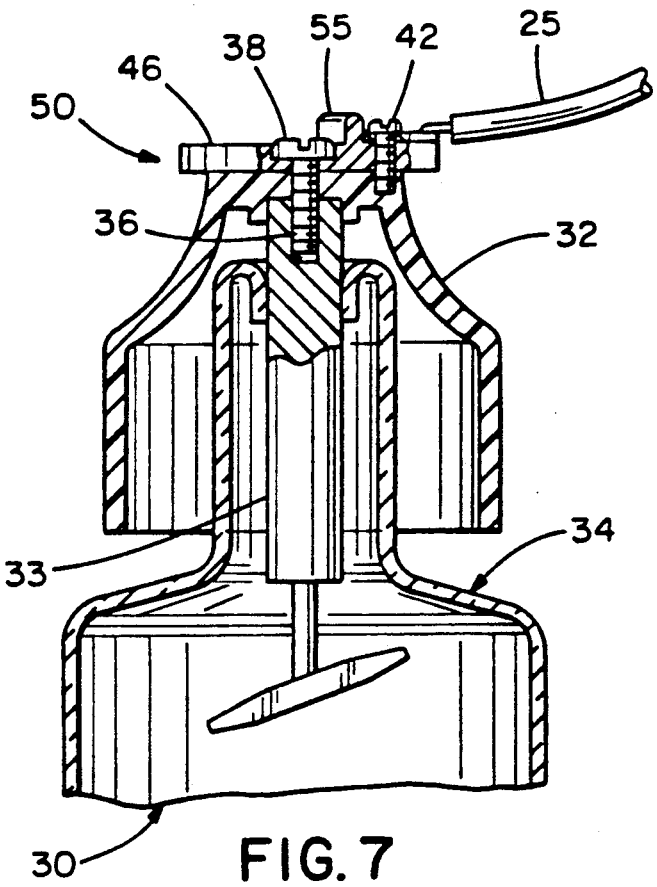
FIG. 7 shows the connection of the disk resistor to the x-ray tube and socket of FIG. 2.

FIG. 7 shows the top of tube socket 32 and x-ray generation tube 34 when disk resistor 50 is in place. In FIG. 7, high voltage conductor 25 is connected by bolt 42 to terminal 51, and terminal 53 is both electrically and physically connected to the anode 33 of x-ray generation tube 34 by bolt 38.

Figure 8:
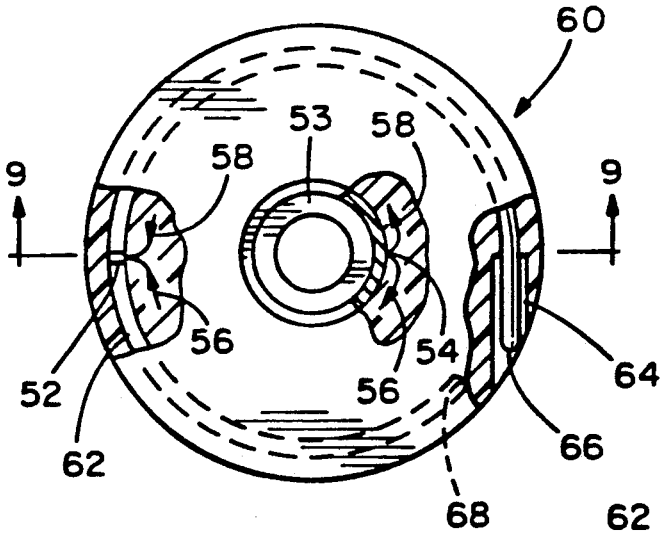
FIG. 8 is a top plan view of an alternate embodiment of the disk-type protection resistor of FIGS. 4 through 6.
Figure 9:
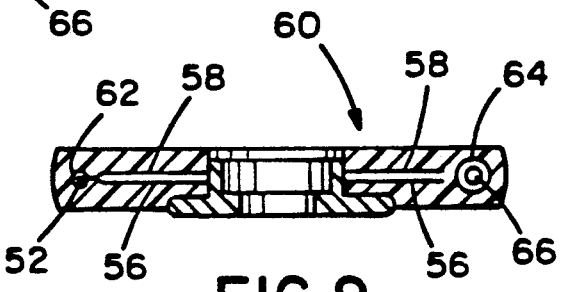
FIG. 9 is a side section view of the resistor of FIG. 8.

FIGS. 8 and 9 represent a top plan view and a side section view of an alternative embodiment of the resistor 50. The overall structure of the resistor 50 is substantially the same as the structure of the prior embodiment (FIGS. 5 and 6), however, terminal 51 is replaced with a slidable banana-type connection shown at 60. In FIG. 8. conductive ring 62 is the electrical replacement for conductive ring 57 of the embodiment of FIGS. 5 and 6. Conductive ring 62 completes approximately 90% of a circle from section line 9—9 to a rounded end point 68. Conductive ring 62 extends beyond section line 9—9 as a straight conductor, running substantially along the tangent of the circular portion of the ring. To accommodate connection of the high voltage input conductor 25 to straight member 66, a cylindrical aperture 64 (FIG. 9) is formed into the encapsulation material of the resistor. A female connector for electrically engaging member 66 has an outer diameter smaller than the diameter of aperture 64.

While specific embodiments of the invention have been illustrated, it will be obvious to those skilled in the art that various modifications and changes may be made thereto without departing from the scope of the invention as defined in the appended Claims.

What is claimed is:

1. A high voltage tube power assembly comprising:

a high voltage source including a high voltage conductor and a return conductor, said source and said conductors having a combined resistance;

a high voltage tube having an anode and a cathode;

a socket for said high voltage tube;

means for connecting said return conductor to said cathode;

a low inductance resistor comprising a first electrical terminal, a second electrical terminal and a resistance substantially equal to the combined resistance of said high voltage source and said conductors connected between said first and second electrical terminals;

means for attaching said resistor to said socket; and means for connecting said high voltage conductor to said second terminal, and for connecting said anode to said first terminal.

2. The assembly of claim 1 wherein said resistor comprises a disk resistor including a plurality of counter-wound resistor elements.

3. The assembly of claim 2 wherein said resistor elements are electrically connected in parallel between said first and said second terminals.

4. The assembly of claim 2 wherein said first terminal comprises a conductive central hub of said disk resistor having an aperture therethrough.

5. The assembly of claim 4 wherein said anode has a threaded aperture therein and said attaching means comprises a threaded member for extending through said hub aperture, through an aperture in said socket and engaging said threaded aperture of said anode.

6. The assembly of claim 5 wherein each of said resistor elements comprises a planar spiral of resistance wire around said hub in a direction opposite to the direction of adjacent ones of said resistor elements.

7. The assembly of claim 6 comprising a conductive ring electrically connected to said second terminal and to a common junction of said resistor elements.

8. The assembly of claim 7 wherein each of said resistor elements comprise a planar spiral of resistance wire around said hub and having a maximum diameter, said conductive ring has an inner diameter larger than said maximum diameter, and said conductive ring is disposed around said resistor elements and in a plane substantially parallel therewith.

9. The assembly of claim 8 wherein said second terminal comprises a threaded aperture for electrical connection to a threaded member.

10. The assembly of claim 8 wherein said second terminal comprises a non-insulated male connector for slidable electrical engagement with a female connector.

* * * * *